US006147328A

United States Patent [19]

Löser et al.

[11] Patent Number: 6,147,328

[45] Date of Patent: Nov. 14, 2000

[54] APPARATUS FOR THE HEAT TREATMENT OF WORKPIECES

[75] Inventors: Klaus Löser, Mainhausen, Germany; Wilfried Zenker, Hartland, Conn.

[73] Assignee: ALD Vacuum Technologies AG, Hanau, Germany

[21] Appl. No.: 09/178,290

[22] Filed: Oct. 23, 1998

[30] Foreign Application Priority Data

Oct. 24, 1997 [DE] Germany ..... 197 47 018

[51] Int. Cl.[7] ..... F27B 9/06

[52] U.S. Cl. ..... 219/388; 34/661; 432/9; 432/11; 432/243

[58] Field of Search ..... 219/388, 521; 392/417; 34/266, 273, 420, 451, 498, 500, 614, 661, 664, 216, 217, 236; 432/9, 11, 123, 128, 143, 146, 147, 243

[56] References Cited

U.S. PATENT DOCUMENTS

| | | | |
|---|---|---|---|
| 3,609,295 | 9/1971 | Bielefeldt | 219/388 |
| 4,086,050 | 4/1978 | Luiten . | |
| 4,610,886 | 9/1986 | Buller-Colthurst | 34/216 |
| 4,886,449 | 12/1989 | Brittin | 432/11 |
| 5,039,841 | 8/1991 | Kato et al. | 219/388 |
| 5,154,338 | 10/1992 | Okuno et al. | 219/388 |
| 5,163,599 | 11/1992 | Mishina et al. | 219/388 |
| 5,273,585 | 12/1993 | Shoga . | |
| 5,871,806 | 2/1999 | Shoga . | |

FOREIGN PATENT DOCUMENTS

| | | |
|---|---|---|
| 4110114 | 10/1961 | Germany . |
| 2117398 | 7/1975 | Germany . |
| 2501360 | 7/1978 | Germany . |
| 3233361 | 2/1987 | Germany . |

*Primary Examiner*—Teresa Walberg
*Assistant Examiner*—Fadi H. Dahbour
*Attorney, Agent, or Firm*—Fulbright & Jaworski, LLP

[57] ABSTRACT

An apparatus for the heat treatment of work pieces comprising comprising a plurality of evacuable chambers connected through airlocks, a conveyor, preferably a circular chain conveyor for the transport of the workpieces along a path through the chambers, an electric resistance heating device, a cooling blower, and a heat exchanger, a plurality of workpieces of equal size and configuration, in particular hacksaw blades, are placed tightly one on top of another and form a stack which is placed into a frame made of profile cuts, whereby the frame is capable of being coupled to a conveyor by means of suspension elements.

10 Claims, 4 Drawing Sheets

APPARATUS FOR THE HEAT TREATMENT OF WORKPIECES

Figure 1:
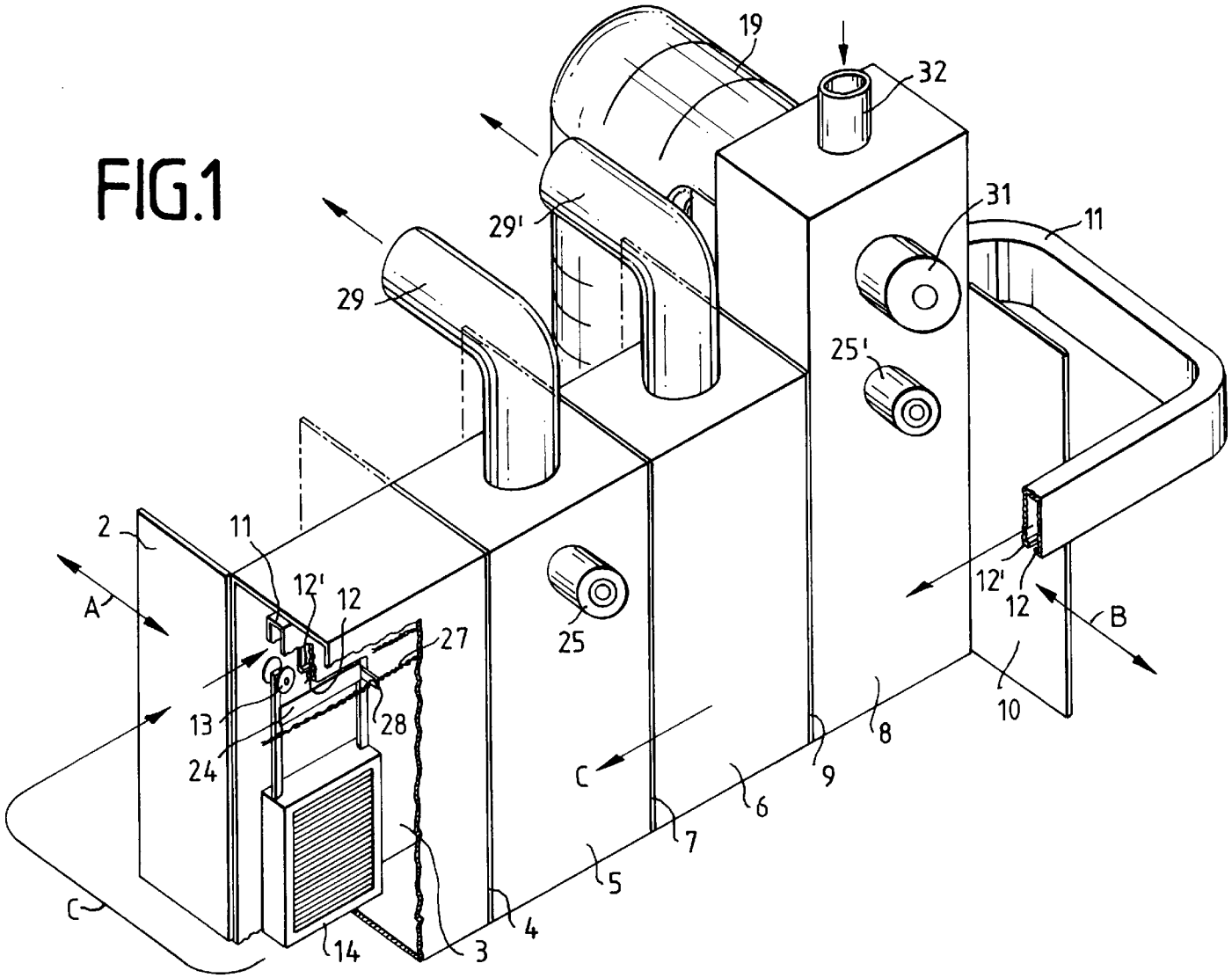

The invention relates to an apparatus for the heat treatment of workpieces with a plurality of evacuable chambers connected through airlocks, a conveyor, preferably a circular chain conveyor, for the transport of the workpieces along a path through the chambers, an electric resistance heating device, a cooling blower, and a heat exchanger.

An apparatus for the heat treatment of workpieces is known (DE 41 10 114) comprising a carburization zone, a quenching zone and a nitrating zone, which zones are designed in series, forming a continuous passage for the steel parts being transported, said passage being divided by doors, and where the quenching zone has a device for forced cooling of the steel parts.

Furthermore, a system is known for the continuous metallurgical treatment of various materials in lower pressure conditions or in vacuum and under high temperature, for example ferro-alloys (OS 15 38 276), where in a low-pressure chamber a separate heating arrangement is provided, said arrangement being equipped with thermal insulation and heating elements, said low-pressure chamber being equipped with a pressure equalization chamber which is connected with said low pressure chamber and which can be separated from it for the loading and removal of the material, where in each of the above-named chambers devices necessary for the process are arranged and which devices are advantageously remote-controlled centrally.

There is further known an continuous-use electric over (DE 32 33 361) for the heat treatment of steel objects, having a horizontally operating transport mechanism, an anterior pre-heating chamber, a heat treatment chamber which is arranged on top of a loading chamber with a vertically operating supply, and a posterior quenching chamber, whereby the heat treatment chamber is capable of being hermetically separated from the loading chamber by means of a floor, and the loading chamber is capable of being separated from the heating chamber by means of heat shields whereby the floor of the preheating chamber and the floor of the quenching chamber upon which floors the steel objects can be moved forward, are movable forward and back in relation to one another such that the steel objects, in connection with retractable stops located in front of and behind the loading chamber, are capable of being moved both onto and from the vertically operating conveyor as well as being capable of being moved up into the heat treatment chamber by the conveyor together with the floor.

Finally there is known a vacuum atmospheric oven for the heat treatment of workpieces with a heat chamber in which a fan is arranged for the circulation of the atmosphere (DAS 25 01 360), where a second fan is added to the fan for the mixing of the atmosphere while avoiding forced circulation, whereby the rotation speed and/or direction of both fans can be changed.

The object of the present invention is to provide an apparatus of the type in questions which is suitable for the heat treatment of relatively thin-walled and narrow workpieces, in particular saw blades, while avoiding deformation of the workpieces as a result of the treatment. The apparatus is to be designed such that a large number of workpieces can be treated simultaneously and that the workpieces can be rapidly introduced into the apparatus for said treatment and/or rapidly removed from it after the completed treatment. Finally, the apparatus is to operate without a device which would make holding and securing of each individual workpiece necessary and would require for this purpose a special mount for each workpiece.

According to the invention this object is achieved in that a plurality of workpieces of equal size and configuration, for example hacksaw blades, are placed, lying closely together and forming a compact block, into an upwardly open frame constructed of profile sections, whereby the frame can be coupled to a conveyor by means of suspension elements.

Additional features and details are characterized and described in more detail in the subordinated claims.

Figure 2:
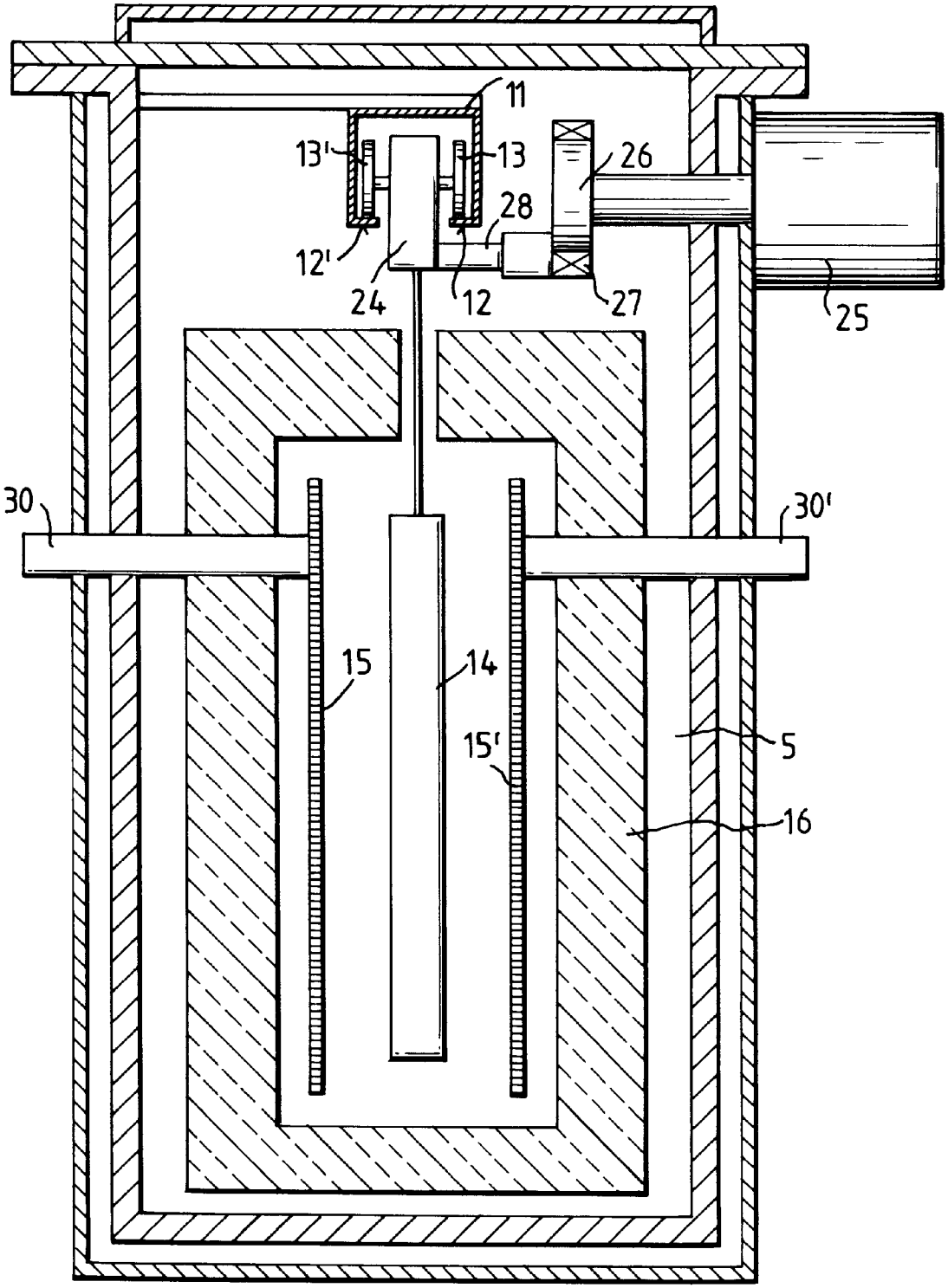
Figure 3:
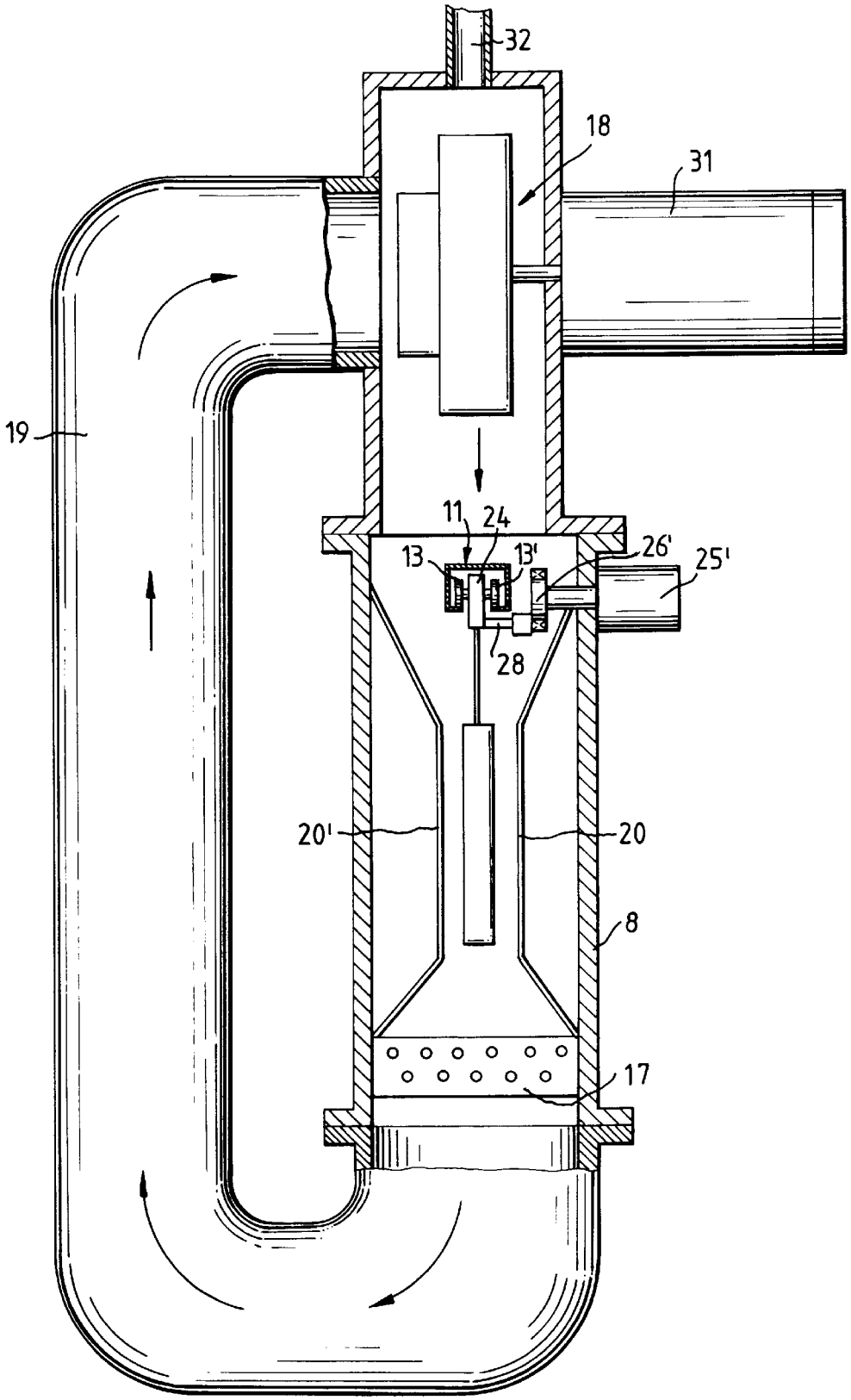
Figure 4:
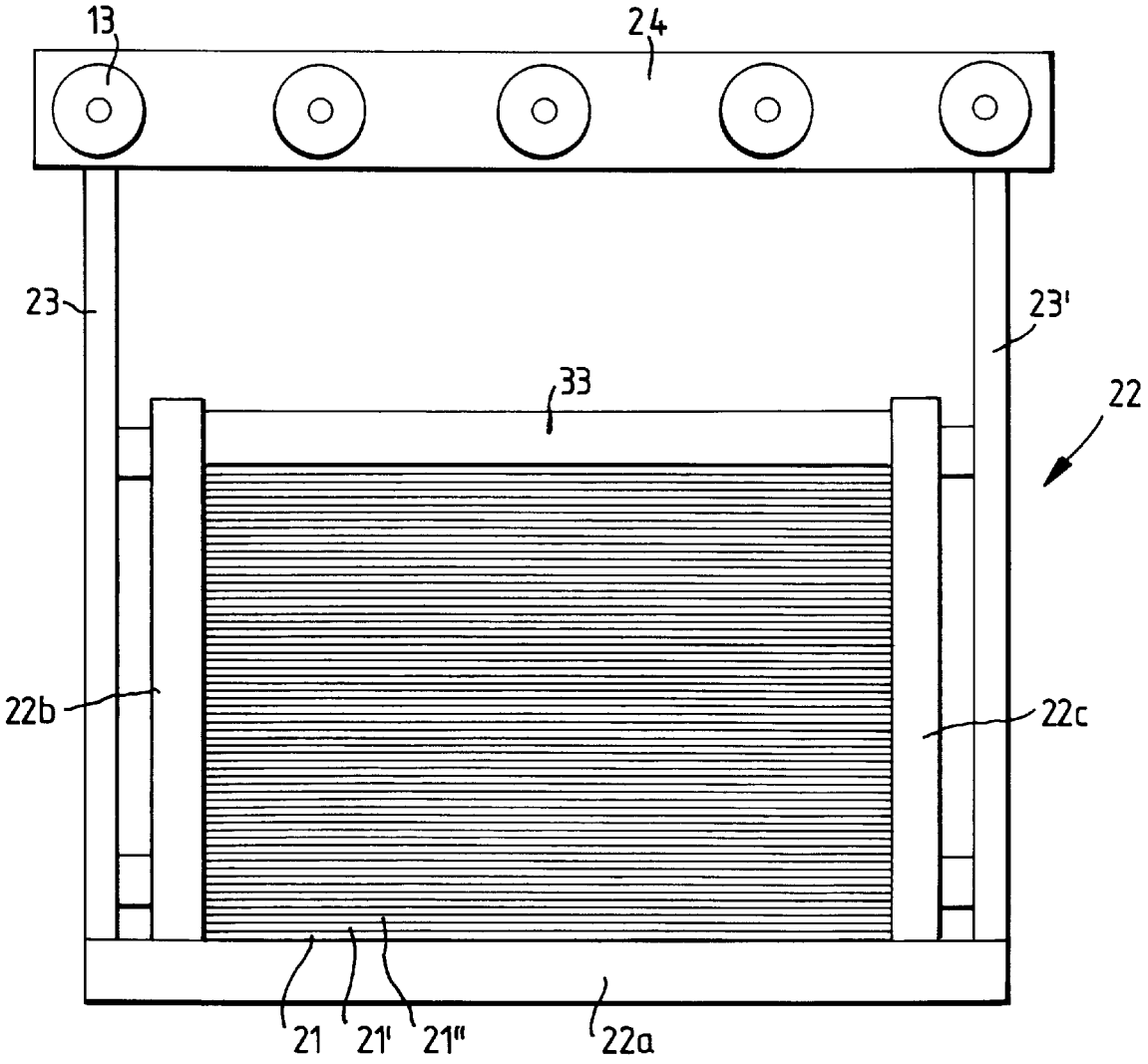

The invention allows for great variety of embodiments, one of which is shown schematically in the appended drawings which show:

in FIG. 1, in a simplified perspective drawing and partially in section, the apparatus according to the invention, with a loading chamber, a preheating chamber, a heat treatment chamber and a quenching chamber, in FIG. 2, a cross section of the preheating chamber according to FIG. 1, in FIG. 3, a cross section of the quenching chamber according to FIG. 1, and in FIG. 4, a front view of the frame with a stack of saw blades held by said frame.

The apparatus for the heat treatment of workpieces substantially comprises a loading chamber 3 with a loading gate 2, a preheat chamber 5 arranged serially behind said loading chamber 3 and separated from it by a gate 4, a heat treatment chamber 6 arranged serially behind said preheat chamber 5 and capable of being separated from it by a gate 7, a quenching chamber 8 with gates 9 and 10, arranged serially behind said heat treatment chamber 6, a track 11 extending through all chambers 3, 5, 6, 8 said track having runner surfaces 12, 12' extending horizontally from the side portions of the track to accommodate the roller pairs 13, . . . of the frame-like workpiece holders 14, . . . , the heating elements 15, 15' arranged in the preheat chamber 5 and enclosed by a well-shaped heat shield 16, a heat exchanger 17 arranged in the quenching chamber 8, and a blower 18 with blower duct 19 and deflector panels 20, 20'.

The individual workpieces, for example saw blades 21, . . . together form a stack which is held by a frame 22 constructed of profile sections, which frame in turn is mounted on a yoke 24 by means of a vertically extending brace 23, 23', said yoke being provided with several roller pairs 13, 13', . . . The yoke 24, with the stack of saw blades 21, 21', . . . suspended from it, is movable along a track 11 which extends through all chambers 3, 5, 6, 8. Said track is approximately U-shaped where both legs are provided with runner surfaces 12, 12' for the roller pairs 13, 13', . . . and said surfaces being part of a circular conveyor. For the heat treatment, the stack of saw blades 21, 21', . . . is moved by the yoke 24 through the cambers 3, 5, 6, 8 for which movement there are arranged on the side walls of the chambers 8 [sic] parallel shafts with gear wheels 26, . . . driven by motors 25, 25', . . . , with a chain 27 extending over the gear wheels 26, . . . , said chain being capable of coupling, by mean of the catches 28, . . . with said yoke 24 and transporting the frame(s) 22, . . . through the chambers 3, 5, 6, 8.

Once a saw blade stack 21, 21', . . . has been loaded into the first chamber 3, the chamber is closed off by the gate 2 so that subsequently the opening of the gate 4 can take place, said gate 4 being connected via a pipe conduit 29 to a vacuum pump, and so that the heating up to the treatment temperature of the saw blades 21, 21', . . . can proceed in the camber 5 under vacuum conditions, after the gate 4 has first been closed. The preheat chamber 5, shown schematically in FIG. 2, has heating elements 15, 15' which are connected to an electrical power source via plate lugs 30, 30'. Once the saw blades stack 21, 21', . . . has reached the desired operating temperature it can be introduced into the chamber 6 which is designed similar to chamber 5 and is connected to a vacuum pump via a pipe conduit 29'. Said stack can remain in chamber 5 for some time at the treatment temperature and under vacuum conditions. Finally the stack is introduced into the quenching chamber 8, the construction of which is shown in more detail in FIG. 3. Said chamber 8 is equipped with a blower 18 which is driven by a motor 31, and has deflector panels 20, 20' which, in the vicinity of the stack, accelerate the quenching gas in the direction indicated by the arrow and then direct said gas to a heat exchanger 17. The quenching gas can be fed into the chamber 8 through fittings 32 and can be drawn off after the cooling process by a pump (not shown) or by a vacuum pump connected to the pipe conduits 29, 29'. After the completed quenching process the stack, suspended on track 11, can be removed from the apparatus in the direction of arrow C through the open gate 10.

A particular advantage of the frame 14 is that the saw blades which are placed one on top of another to form a stack are on the one hand prevented by their own weight from deforming, and on the other can be kept at a temperature which remains approximately stable. To ensure that the blades uppermost in the stack are not also subjected to deformation, the stack 21, 21', . . . is weighted down by a weight 33 which has a length and a width approximately equal to that of the blades and which can be placed into the frame parts 22*b*, 22*c* formed from U-shaped profile sections.

Reference key

2 Loading gate
3 Loading chamber
4 Gate
5 Heating chamber
6 Heat treatment chamber
7 Gate
8 Quenching chamber
9 Gate
10 Gate
11 Track
12, 12', . . . Runner surface
13, 13', . . . Roller pair
14 Workpiece holder
15, 15' Heating element
16 Heat shield
17 Heat exchanger
18 Blower
19 Blower duct
20, 20' Deflector panel
21, . . . Workpiece, saw blade
22, 22*a*, 22*b* Frame
24 Yoke
25 Motor
26, . . . Gear wheel
27 Chain
28 Catch
29 Pipe conduit
30, 30' Plate lugs
31 Motor
32 Gas connection
33 Weight

What is claimed is:

1. Apparatus for the heat treatment of workpieces comprising a plurality of evacuable chamber, at least one of the chambers being a heating chamber heated by a heating element and at least one of the chambers being a cooling chamber connected through airlocks, a conveyor for the transport of the workpieces along path having a transport direction through the chambers, and electric resistance heating device, a cooling blower, and a heat exchange, wherein a plurality of workpieces of equal size and configuration lay closely together and form a compact block and are placed into a frame constructed of profile sections, whereby the frame is coupled to a conveyor by means of suspension elements, wherein said frame comprises a lower frame part which extends horizontally and is carrying at least two vertically extending side parts formed from profile sections facing each other in pairs for holding the ends of workpieces, whereby the frame is adapted to be connected to at least one set of two vertically extending side parts comprising profile sections facing each other for holding the workpieces, whereby said frame is adapted to be connected to the conveyor by means of suspension elements.

2. Apparatus according to claim 1, wherein the workpieces are held in the frame, and form a stack weighted down by a prism-shaped weight placed on the uppermost workpiece and said frame having side parts, to hold down said workpieces.

3. Apparatus according to claim 1, wherein the frame holding down said workpieces is transported through the evacuable chambers whereby the longitudinal alignment of said workpieces corresponds to the transport direction and whereby the suspension elements of the frame are dimensioned upwardly such that said frame includes a yoke which is located outside of an effective zone of the heating elements of the heating chamber.

4. Apparatus according to claim 1, wherein a total of four chambers is provided, said chambers are connected via gates, whereby the first chamber and the last chamber are opened to an outside via gates.

5. Apparatus according to claim 1, wherein the path of the workpieces has at least two sides and wherein in a chamber for the cooling of the workpieces deflector panels is provided on both sides of the path of the workpieces, said deflector panels direct a cooling gas stream directly past the path of the workpieces, whereby the blower is provided above the conveyor and the heat exchanger is provided below the space provided for passage of the workpieces.

6. The apparatus of claim 1, wherein the conveyor is a circular chain conveyor.

7. Apparatus for the heat treatment of sawblades of equal size and configuration by heating and quenching comprising a plurality of evacuable chambers connected through airlocks, a conveyor for the transport of the sawblades along a path having a transport direction through the chambers, one of the said chambers being a heating chamber with an electric resistance heating device and another one of said chambers being a quenching chamber with a cooling blower and a heat exchanger, said apparatus having a frame means being connectable by suspension elements to said conveyor, said frame means comprising:

(a) a lower frame part which extends horizontally and supports said sawblades, which form a compact block in which the sawblades are lying closely on top of one another;

(b) at least one set of two vertically extending side parts comprising profile sections, each of which holds the ends of the said sawblades, wherein said frame and said sawblades are conveyed in their longitudinal alignment to the transport direction through said chambers; and, (c) a yoke at the upper part of said frame, said yoke being located outside of an effective zone of the heating elements of the heating chamber.

8. Apparatus for the heat treatment of workpieces comprising a plurality of evacuable chambers, at least one of the chambers being a heating chamber heated by a heating element and at least one of the chambers being a cooling chamber connected through airlocks, a conveyor for the transport of the workpieces along a path having a transport direction through the chambers, an electric resistance heating device, a cooling blower, and a heat exchanger, wherein a plurality of workpieces of equal size and configuration lay closely together and form a compact block and are placed into a frame constructed of profile sections, whereby the frame is coupled to a conveyor by means of suspension elements wherein the workpieces are held in the frame and form a stack weighted down by a prism-shaped weight placed on the uppermost workpiece and said frame having side parts to hold down said workpieces.

9. Apparatus for the heat treatment of workpieces comprising a plurality of evacuable chambers, at least one of the chambers being a heating chamber heated by a heating element and at least one of the chambers being a cooling chamber connected through airlocks, a conveyor for the transport of the workpieces along a path having a transport direction through the chambers, an electric resistance heating device, a cooling blower, and a heat exchanger, wherein a plurality of workpieces of equal size and configuration lay closely together and form a compact block and are placed into a frame constructed of profile sections, whereby the frame is coupled to a conveyor by means of suspensions elements, wherein four chambers are provided, said chambers being connected via gates, whereby the first chamber and the last chamber are opened to the outside via gates.

10. Apparatus for the heat treatment of workpieces comprising a plurality of evacuable chambers, at least one of the chambers being a heating chamber heated by a heating element and at least one of the chambers being a cooling chamber connected through airlocks, a conveyor for the transport of the workpieces along a path having a transport direction through the chambers, and electric resistance heating device, a cooling blower, and a heat exchanger, wherein a plurality of workpieces of equal size and configuration lay closely together and form a compact block and are placed into a frame constructed of profile sections, whereby the frame is coupled to a conveyor by means of suspension elements, wherein the path of the workpieces has at least two sides and wherein in a chamber for the cooling of workpieces a deflector panel is provided on both sides of the path of the workpieces, said deflector panels direct a cooling gas stream directly past the path of the workpieces, whereby the blower is provided above the conveyor and the heat exchanger is provided below the space provided for passage of the workpieces.

* * * * *